US005370207A

United States Patent [19]

Hongo

[11] Patent Number: 5,370,207

[45] Date of Patent: Dec. 6, 1994

[54] MOTION BUFFER FOR A PEOPLE MOVING DEVICE

[75] Inventor: Masaharu Hongo, Yamato, Japan

[73] Assignee: Otis Elevator Company, Farmington, Conn.

[21] Appl. No.: 47,218

[22] Filed: Apr. 14, 1993

[30] Foreign Application Priority Data

Apr. 22, 1992 [JP] Japan ..... 4-025742[U]

[51] Int. Cl.[5] ..... B66B 5/28

[52] U.S. Cl. ..... 187/343; 267/205; 187/372

[58] Field of Search ..... 187/67, 88, 86, 95, 187/32, 34, 36; 188/371; 267/205; 213/220, 221

[56] References Cited

U.S. PATENT DOCUMENTS

| | | | |
|---|---|---|---|
| 568,345 | 9/1896 | Gilpin et al. | 187/67 |
| 947,477 | 1/1910 | Wilcox et al. | 267/205 |
| 3,327,811 | 6/1967 | Mastroberte | 187/38 |

FOREIGN PATENT DOCUMENTS

| | | | |
|---|---|---|---|
| 795965 | 10/1935 | France | 267/205 |
| 812816 | 10/1936 | France | 187/67 |
| 1226439 | 3/1971 | United Kingdom | 187/88 |
| 1331785 | 8/1987 | U.S.S.R. | 187/88 |

*Primary Examiner*—Kenneth W. Noland

[57] ABSTRACT

A motion buffer for stopping a car traveling along a guide rail is provided, having a wedge and a biasing apparatus for biasing against the wedge. If the car travels far enough along the guide rail to encounter the wedge, the biasing apparatus becomes biased against the wedge, thereby stopping the car.

6 Claims, 2 Drawing Sheets

MOTION BUFFER FOR A PEOPLE MOVING DEVICE

DESCRIPTION

1. Technical Field

This invention relates to people moving devices, and to motion buffers in particular.

2. Background Art

Many people moving devices, including elevators, comprise a car guided along a particular route by a guide rail. For safety reasons, the cars include a number of speed limiting devices designed to prevent an overspeed condition or a collision at the end of the route. In an elevator, for example, a first speed limiting device is typically an electromechanical device which reduces or eliminates the power to the drive. If the first speed limiting device fails, as it would if the ropes suspending the car were to fail, then a second speed limiting device is implemented.

The second speed limiting device is typically a centrifugally actuated mechanical device. In U.S. Pat. No. 3,327,811 to Mastroberte, for example, a centrifugally operated brake grips a governor rope in an overspeed condition. The governor rope, in turn, actuates a pair of safeties attached to the car. The safeties frictionally grip the guide rails of the elevator, thereby causing the elevator car to stop.

If the safeties fail to stop the car, however, or only slow it down, a third speed limited device, a motion buffer, is positioned in the bottom, or "pit", of the hoistway. There are a variety of buffers known in the art, generally fitting into three categories. The first category may be described as coil spring buffers. These buffers are basically large, stiff coil springs which dampen and dissipate the motion of the elevator. The problem with this type of buffer is that the elevator may rebound a number of times before the spring totally dissipates the energy of the car. The bouncing motion of the elevator represents a safety hazard.

The second category of buffers may be described as hydraulic buffers. Hydraulic buffers generally comprise a hydraulic cylinder having a fluid. Under force, fluid in the cap end of the cylinder passes through orifices to the rod end of the cylinder. The energy of the car striking the cylinder rod is dissipated as the fluid passes between the two compartments. The disadvantages of this type buffer is that the cylinder requires a relatively long stroke to stop the car, especially in high-rise applications.

The third category of buffers may be described as frangible buffers. Frangible buffers typically comprise a cylinder and a truncated cone. When the car travels far enough, the cylinder is forced on the cone, causing the cylinder to deform into a plurality of sections. The deformation of the cylinder dissipates the energy of the car. The disadvantage of this type of buffer, however, is that once a buffer has been used, the cylinder must be replaced.

What is needed is a buffer which does not rebound, which uses a minimum of hoistway space, and which does not have to be replaced after each use.

DISCLOSURE OF THE INVENTION

It is, therefore, an object of the present invention to provide a buffer which may be used more than one time.

It is a further object of the present invention to provide a buffer which does not rebound.

It is still a further object of the present invention to provide a buffer which minimizes the amount of space necessary in the hoistway.

According to the present invention, a motion buffer for stopping a car traveling along a guide rail is provided, having a wedge and a biasing means for biasing against the wedge. If the car travels far enough along the guide rail to encounter the wedge, the biasing means becomes biased against the wedge, thereby stopping the car.

According to one aspect of the present invention, the biasing means comprises a pair of leaf springs, mounted on the car. When the biasing means encounters the wedge, the leaf springs are laterally deflected, thereby stopping the car.

According to another aspect of the present invention, a method for stopping an elevator car traveling along the guide rail is provided.

One advantage of the present invention is that the present invention may be used more than one time. As a result, the buffer may be used for testing or actual situations without having to be replaced.

A further advantage of the present invention is that the present invention absorbs all the energy of the car, thereby preventing the car from rebounding and possibly causing injury to passengers within the car.

A still further advantage of the present invention is that the present invention mounts on the car and the guide rails, thereby minimizing the necessary hoistway space.

These and other objects, features and advantages of the present invention will become apparent in light of the detailed description of the best mode embodiment thereof, as illustrated in the accompanying drawings.

DETAILED DESCRIPTION OF THE DRAWINGS

BEST MODE FOR CARRYING OUT THE INVENTION

Figure 1:
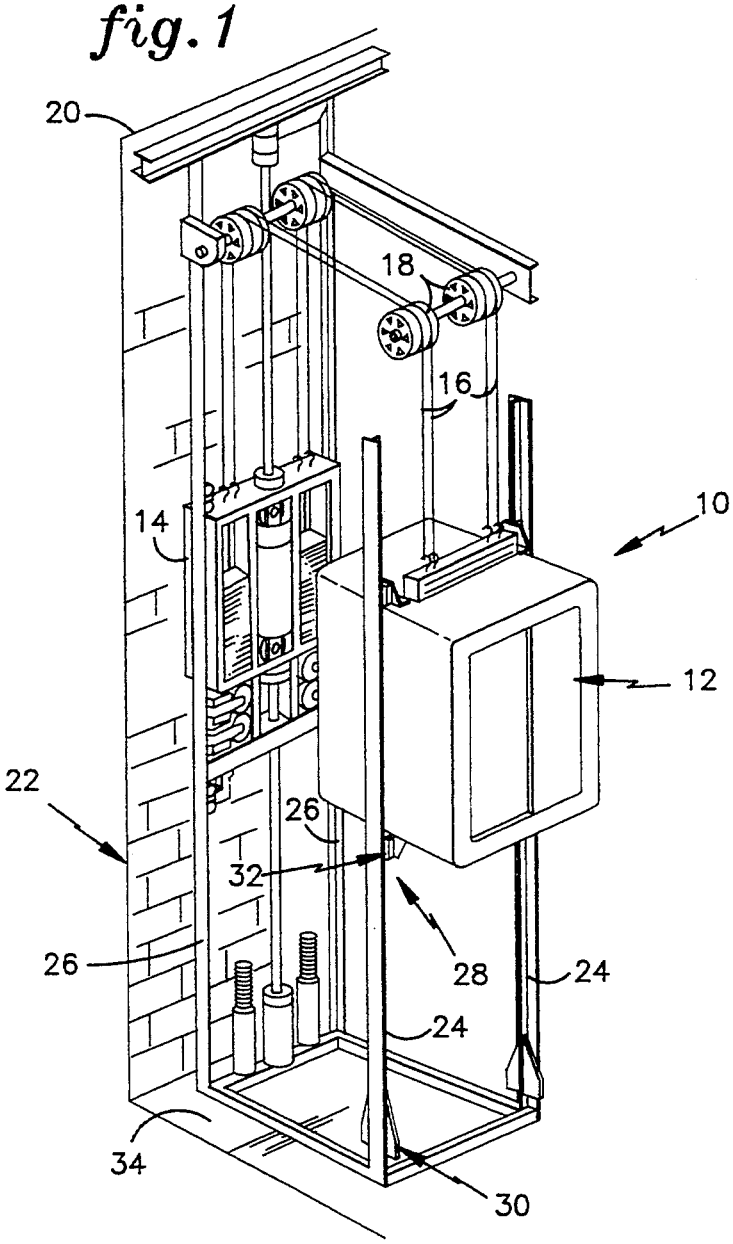
FIG. 1 is a diagrammatic view of an elevator.

Referring to FIG. 1, an elevator 10 is shown having a car 12 and a counterweight 14 attached to each other by a plurality of ropes 16. The ropes 16 extend upwardly from the car 12 to a plurality of sheaves 18 located at the top 20 of the hoistway 22. After passing over the sheaves 18, the ropes 16 extend back downwardly to a counterweight 14. The car 12 and the counterweight 14 are constrained to vertical motion within the hoistway 22 by a pair of first 24 and second 26 guide rails, respectively.

Figure 2:
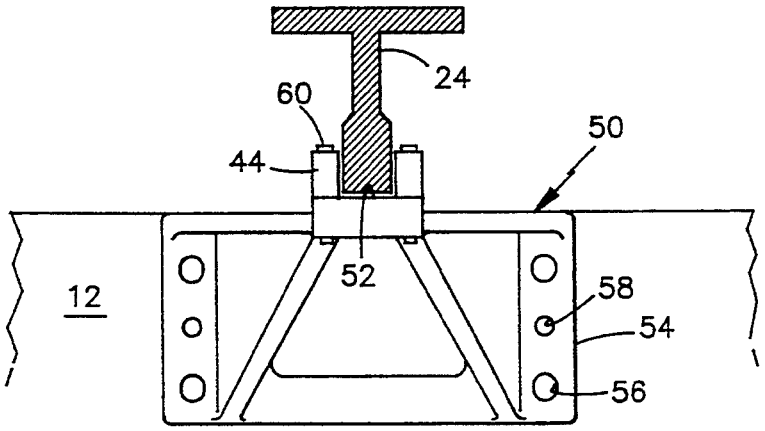
FIG. 2 is a bottom view of the biasing means attached to the elevator car of FIG. 1 (guide rail not shown).
Figure 3:
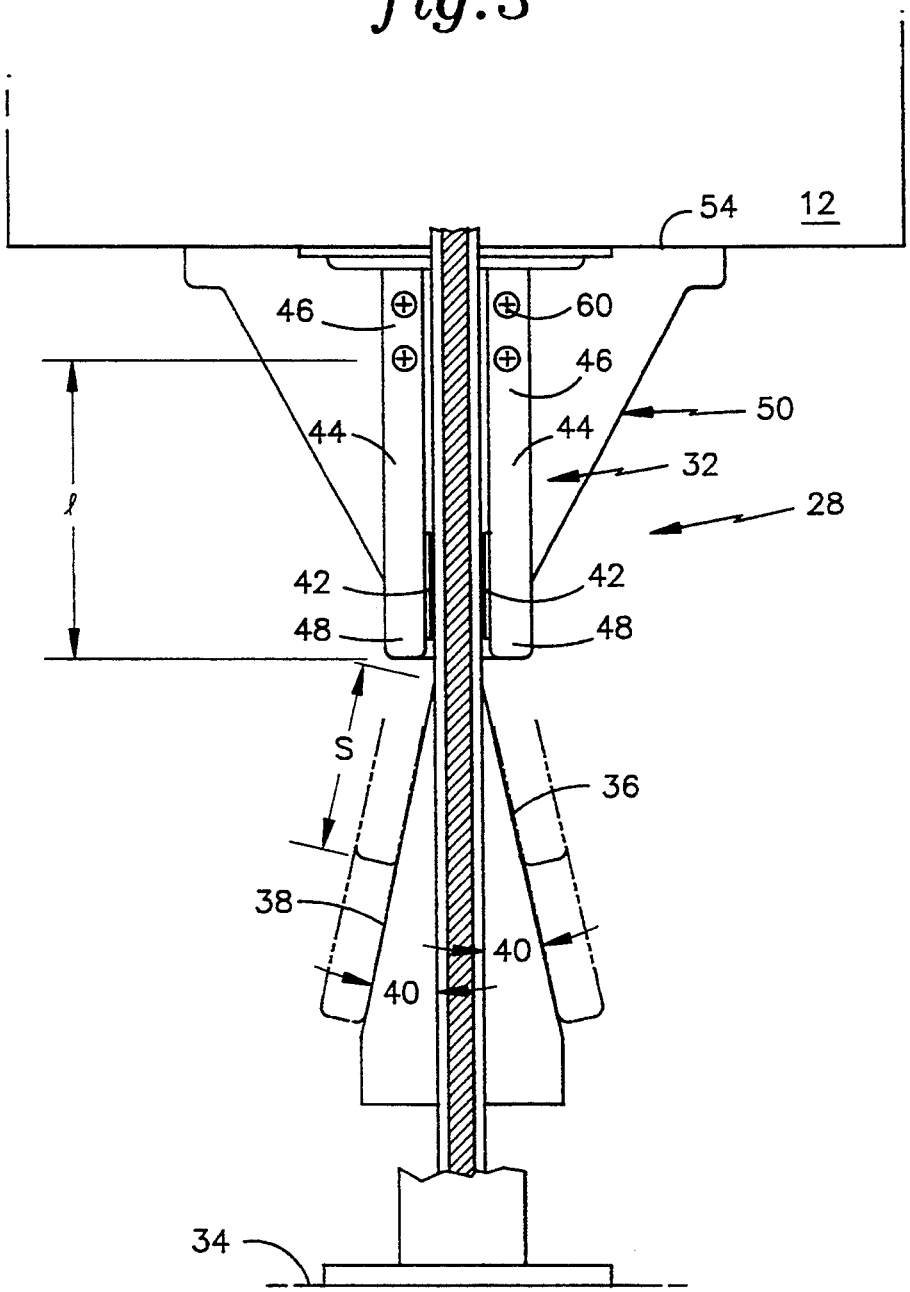
FIG. 3 is a diagrammatic view of the biasing means and wedge of FIG. 1.

Referring to FIG. 3, a buffer 28, having a wedge 30 and a biasing means 32 is provided on each side of the car 12 (see FIG. 1) to stop the car 12 at the bottom 34 of the hoistway 22 if necessary. Each wedge 30 has a first surface 36 and a second surface 38 oriented at an acute angle 40 from the centerline of the wedge 30. Each biasing means 32 comprises a pair of guide shoes 42 and a pair of leaf springs 44, having a first 46 and second end 48. A bracket 50 for mounting the biasing means 32 has a first face 52 (see FIG. 2) and a second face 54. The second face 54 includes a plurality of slots 56 and holes 58. The guide shoes 42 are fixed to the leaf springs 44 by conventional means such as a threaded fastener (not shown). A conventional attachment means, such as a hardened bolt 60, fixes the first end 46 of each leaf spring 44 to the first face 52 of each bracket 50, thereby making each leaf spring 44 a cantilever.

For a particular size elevator 10, it is necessary to size the buffer 28 to ensure the buffer 28 will be able to absorb all the energy of a free falling car 12; i.e. a worst case scenario. The energy of the car 12 can be described in terms of kinetic energy ($E_v$) and potential energy ($E_h$), where (as is known in the art):

$$E_v = \tfrac{1}{2}mv^2$$

$$E_h = mgh$$

The total amount of energy to be dissipated, therefore, can be expressed in the following inequality:

$$2 \times E_b > E_v + E_h$$

where "$E_b$" is the amount of energy to be dissipated by each buffer 28, or the work done by each buffer 28. The work done by each buffer 28 can be calculated using the expression A:

$$W = \int F \cdot dx$$

Where "F" is the force necessary to deflect a cantilever beam and the differential "dx" is the change in the amount the beam is deflected. Substituting in for "F" an equation which describes the deflection ($\delta$) of a cantilever beam (as is known in the art) for a given load "P":

$$\delta = \frac{P l^3}{3 E I_x}$$

Expression A can then be expressed as:

$$E_b = \left( \int_b^s \frac{3 \times x \tan\theta \, E I_x g}{l^3} dx \right) \times 2$$

where:

S=the distance traveled by the biasing means along the wedge;

x=lateral deflection of the biasing means;

E=Young's modulus of the leaf spring;

$I_x$=moment of inertia of the area;

l=cantilevered length of the leaf spring;

g=gravity;

$\theta$=the angle of the first and second surfaces of the wedge.

In sum, given these equations, the size of each buffer 28 can be determined for a particular application.

Referring to FIG. 1, within the hoistway 22 a wedge 30 is fixed to each first guide rail 24 at the bottom 34 of the hoistway 22. The wedge 30 is positioned so that the point of the wedge 30 points upwardly. The biasing means 32 is mounted on the bottom of each side of the car 12 adjacent the first guide rails 24. A person of ordinary skill in the art will recognize that the wedge 30 and biasing means 32 may be positioned at a position other than the bottom of the hoistway and car, respectively. For example, the wedge 30 and biasing means 32 could be positioned along side the car 12 when the car 12 is at, or near, the bottom 34 of the hoistway 22.

Referring to FIG. 2, the biasing means 32 on each side of the car 12 is attached to the first face 52 of the bracket 50. The second face 54 of each bracket 50, in turn, is fixed to the car 12. The plurality of slots 56 in the second face 54 enable the bracket 50, and therefore the biasing means 32, to be adjustably positioned in close proximity to the first guide rails 24. Once the brackets 50 are properly positioned, the brackets 50 are pinned to the car 12 through the holes 58 in the second face 54.

Referring to FIG. 3, the leaf springs 44 of each buffer 28 are positioned on opposite sides of each first guide rail 24, such that the attached guide shoes 42 face the guide rail 24. The first end 46 of each leaf spring 44 is fixed to the bracket 50 by a pair of hardened bolts 60. A person of ordinary skill in the art will recognize that the cantilever leaf springs 44 may be attached by a variety of fasteners and or mounting brackets. A person of ordinary skill in the art will further recognize that the biasing means 32 may be used without guide shoes 42.

When the car 12 travels far enough to permit each biasing means 32 to encounter a wedge 30, the leaf springs 44 of each biasing means 32 contact the first 36 and second 38 surfaces of the wedge 30. As a result, the wedge surfaces 36,38 force the leaf springs 44 to deflect laterally. Hence, the energy of the car 12 becomes the energy necessary to deflect the leaf springs 44. The car 12 will travel toward the wedge 30, thereby causing the leaf springs 44 to laterally deflect, until the energy of the car 12 is totally dissipated. Friction between the leaf spring 44 and the wedge 30 on each side of the wedge 30 prevents the car 12 from rebounding. To reset the buffer 28, the car 12 is pulled up off of the wedge 30 and the leaf springs 44 return to their original position.

In sum, the present invention provides a number of advantages over the existing buffer art: First, the buffer 28 may be used more than once; Second, the wedge 30 and biasing means 32 arrangement prevents the car 12 from rebounding; and Third, the wedge 30 and biasing means 32 arrangement may be positioned at the bottom 34 of the hoistway 22 or along side the car 22 when the car 12 is at the bottom 34 of the hoistway 22. In any case, the space requirements of the buffer 28 and the hoistway 22 are minimized.

Although this invention has been shown and described with respect to the detailed embodiments thereof, it will be understood by those skilled in the art that various changes in form and detail thereof may be made without departing from the spirit and scope of the claimed invention.

I claim:

1. A buffer for stopping a car traveling along a guide rail, comprising:

a wedge, attached to the guide rail; and a biasing means, mounted on the car in close proximity to the guide rail;

wherein when the car travels far enough along the guide rail to encounter said wedge, said biasing means becomes biased against said wedge, thereby stopping the car.

2. A buffer for stopping a car traveling along a guide rail, according to claim 1, wherein said biasing means further comprises:

a pair of leaf springs, having a length defined by a first end and a second end;

wherein an attachment means attaches said first end of each of said leaf springs to the car in close proximity to the guide rail.

3. A buffer for stopping a car traveling along a guide rail, according to claim 2, further comprising:

a pair of guide shoes, mounted on said second end of said leaf springs, facing the rail;

wherein when the car travels far enough along the guide rail to encounter said wedge, said leaf springs bias said guide shoes against said wedge, thereby stopping the car.

4. A buffer for stopping a car traveling along a guide rail, according to claim 2, further comprising:

a bracket, for mounting said leaf springs on the car, said bracket having a means for adjustably positioning said leaf springs relative to the guide rail.

5. A buffer for stopping an elevator car traveling vertically along a guide rail in a hoistway, comprising:

a wedge, attached to the rail;

a pair of guide shoes, mounted on the car in close proximity to the rail; and means for biasing said guide shoes against said wedge, said means attached to the car;

wherein when the car descends far enough along the guide rail to encounter said wedge, said biasing means biases said guide shoes against said wedge, thereby causing the car to stop.

6. A method for stopping an elevator car traveling along a guide rail, comprising the steps of:

providing a wedge, attached to the guide rail;

providing a biasing means attached to the car; and impinging said biasing means on said wedge to stop said car, wherein impinging said biasing means on said wedge dissipates the energy of the car traveling along the guide rail, thereby preventing the car from rebounding.

* * * * *